United States Patent [19]

Hovnanian

[11] Patent Number: 4,944,151

[45] Date of Patent: Jul. 31, 1990

[54] SEGMENTED COMBUSTOR PANEL

[75] Inventor: Camer V. Hovnanian, Fairfield, Conn.

[73] Assignee: Avco Corporation, Providence, R.I.

[21] Appl. No.: 445,119

[22] Filed: Nov. 30, 1989

Related U.S. Application Data

[63] Continuation of Ser. No. 249,455, Sep. 26, 1988, abandoned.

[51] Int. Cl.[5] ..... F23R 3/60

[52] U.S. Cl. ..... 60/39.32; 60/752

[58] Field of Search ..... 60/752, 757, 754, 39.31, 60/39.32; 403/DIG. 10; 24/536, DIG. 9

[56] References Cited

U.S. PATENT DOCUMENTS

| | | | |
|---|---|---|---|
| 2,547,619 | 4/1951 | Buckland | 60/756 |
| 2,884,759 | 5/1959 | Sevcik | 60/39.32 |
| 2,988,886 | 6/1961 | Hamm et al. | 60/752 |
| 3,408,812 | 11/1968 | Stenger | 60/757 |
| 3,840,332 | 10/1974 | Smith | 60/39.32 |
| 4,071,194 | 1/1978 | Eckert et al. | 60/755 |
| 4,302,932 | 12/1981 | Kuznetsov et al. | 60/39.32 |
| 4,696,431 | 9/1987 | Buxe | 60/752 |
| 4,848,089 | 7/1989 | Cramer | 60/39.32 |
| 4,864,818 | 9/1989 | Taylor | 60/39.32 |

FOREIGN PATENT DOCUMENTS

| | | | |
|---|---|---|---|
| 892948 | 4/1962 | United Kingdom | 60/752 |

*Primary Examiner*—Louis J. Casaregola
*Assistant Examiner*—Timothy S. Thorpe
*Attorney, Agent, or Firm*—Perman & Green

[57] ABSTRACT

A system of mounting segmented liner panels on the interior of an outer shell of a combustion chamber for a gas turbine engine. The system is effective to enable higher temperatures to be maintained thereby increasing engine efficiency while simultaneously guarding against structural failure. A plurality of concentrically disposed segmented liner panels are arranged in side by side circumferential relationship at successive axial locations. Each liner panel is fixed relative to the outer shell at one location proximate to a leading portion. In addition, each liner panel is restrained against radial movement relative to the outer shell, but relative axial and circumferential movement between the liner panel and outer shell is permitted. Mating spacer hooks and spring clip members are selectively engageable to mount a trailing portion of each liner panel to the outer shell. Lateral edges of adjacent liner panels are mutually configured to prevent escape of heat while accommodating circumferential expansion.

16 Claims, 2 Drawing Sheets

FIG. 2
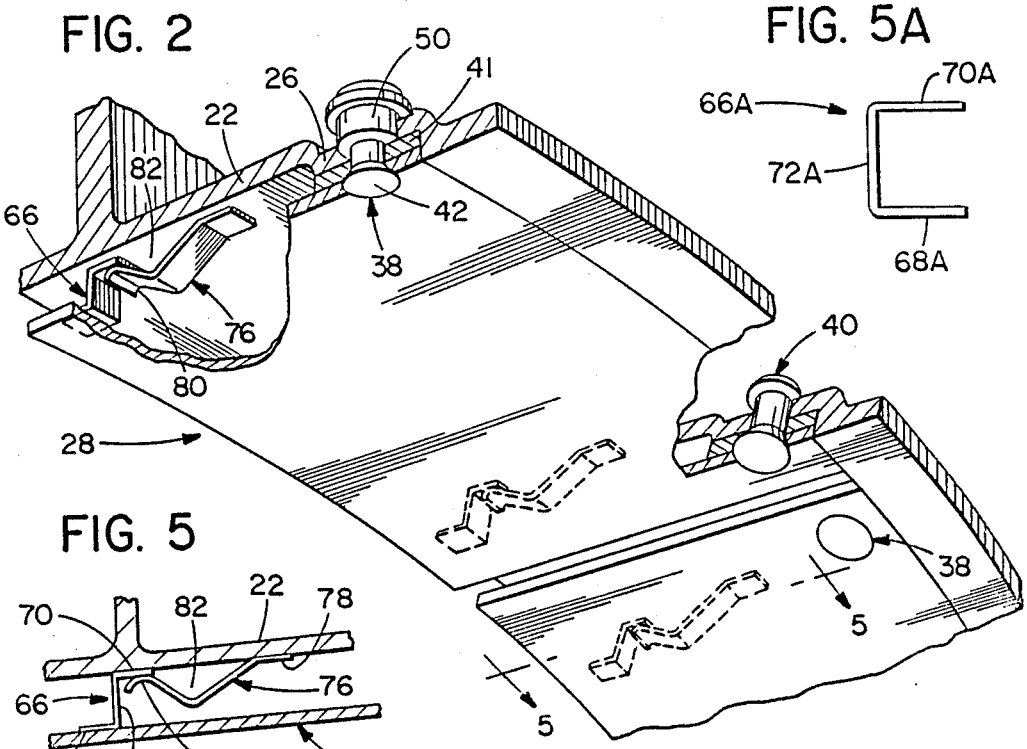
FIG. 5A
FIG. 5
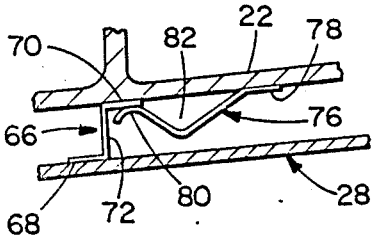
FIG. 6
FIG. 7
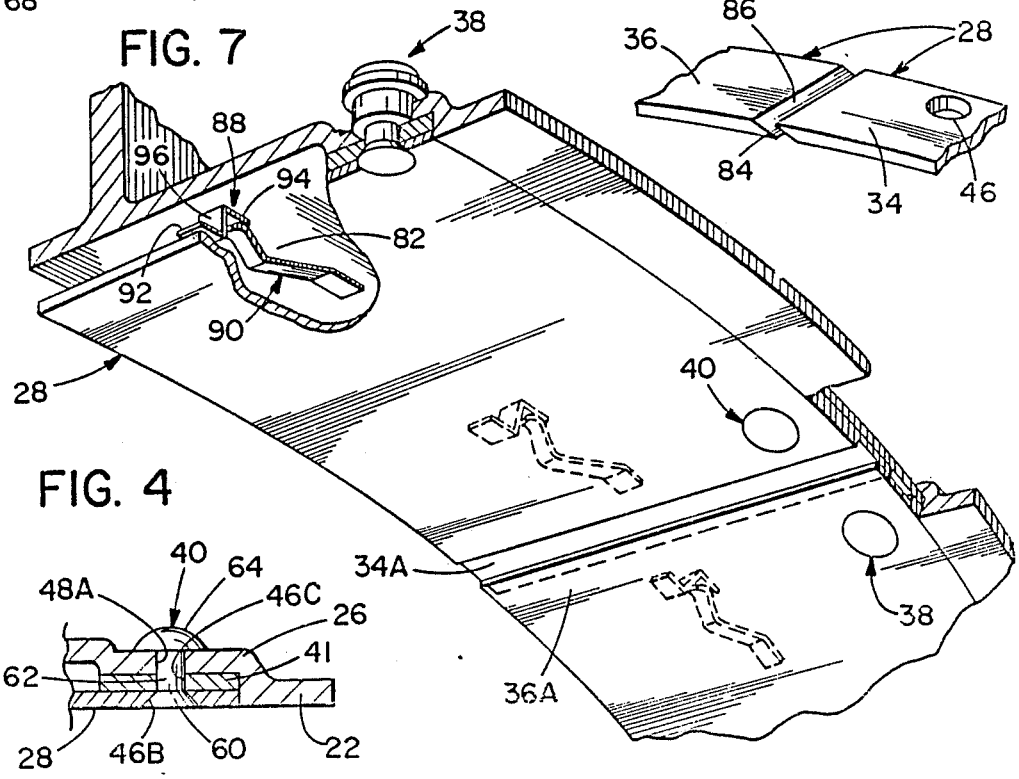
FIG. 4

SEGMENTED COMBUSTOR PANEL

This is a continuation of copending application Ser. No. 07/249,455 filed on 9/26/88 now abandoned.

BACKGROUND OF THE INVENTION

1. Field of the Invention

The present invention relates to gas turbine engines and, more particularly, to combustion chambers for use therein.

2. Description of the Prior Art

Gas turbine engine efficiency is a function of various parameters, among them the temperature achievable within combustion chambers, as well as the amount of air which must be diverted to cool various components of the engine. Contemporaneously, the structural integrity of an engine is improved if structural loads are carried by engine components which are not also subjected to high temperatures and attendant thermal stresses.

In an attempt to raise achievable temperatures within combustion chambers, various materials and alloys have been proposed and used in the construction of the chambers. Among those materials which exhibit particularly beneficial resistance to thermal effects are so-called superalloys, oxide dispersion strengthened materials, and various ceramics. This invention may employ these and other appropriate materials in the construction of the improved combustion chamber being disclosed.

The effective application of such high temperature materials as those discussed, in addition to enabling higher temperatures to be reached, also allow a reduction in the amount of cooling fluid required to be directed to the combustion chamber during operation. This reduction enables the engine to operate with increased efficiency.

Structural failures in gas turbine engines in the past have sometimes resulted from the subjection of structural load-bearing portions of the engine to thermal stresses associated with high temperatures of combustion. The formation of a combustion chamber in a way that requires the chamber liner (which is directly exposed to the heat of combustion) to carry structural loads associated with the combustion chamber has sometimes resulted in such failures.

For some time now, in order to achieve the cooling required while effectively withstanding the structural and thermal stresses to which the components of a combustion chamber are subjected, it has been known to provide spaced walls formed at the inner surface of the combustion chamber and attached end over end in louver fashion to form the combustion chamber, and further to provide a plurality of open-ended longitudinal passageways. By reason of the louver construction, the upstream end accepts cooling air from the surrounding space and discharges it from the passageways at the downstream end into the combustion chamber. Succeeding louver sections pick up and discharge the cooling air in a like manner.

U.S. Pat. No. 4,302,941 discloses such a construction in which a hot liner wall is segmented in both the axial and circumferential direction. The axial segments are sufficiently spaced whereby film cooling provides adequate cooling between axial segments and the space between segments in the circumferential direction permit circumferential growth. The circumferential growth negates the possibility of radial growth and minimizes detrimental thermal stress and leaves the cooling flow passages relatively undisturbed. According to that patent, each segment may be secured relative to a cool wall by a nut and bolt arrangement designed to achieve minimum stresses.

An improved construction is disclosed in U.S. Pat. No. 4,512,159 according to which the liner segments are attached by a spring clip adapted to fit onto an integral post machined on the segment so as to preload the panel in a radial direction. Because this is virtually the only load on the spring clip notwithstanding the high temperature environment, such a retention system is said to be highly durable, improving the maintainability of the combustor liner. Since the clips are removable without damage to the post, the removal of panels is facilitated which are also said to enhance the maintainability of the combustor. Unfortunately, this system exhibits serious drawbacks including the cost of machining large numbers of the posts on the liner segments as well as the large number of resulting irregular-shaped protuberances thereby created on an outer surface of the outer shell.

SUMMARY OF THE INVENTION

It was with knowledge of the prior art as generally described above and the problems existing which gave rise to the present invention. To this end, a system of mounting segmented liner panels on the interior of an outer shell of a combustion chamber for a gas turbine engine is disclosed. The system is effective to enable higher temperatures to be maintained increasing engine efficiency while simultaneously guarding against structural failure. A plurality of concentrically disposed segmented liner panels are arranged in side by side circumferential relationship at successive axial locations. Each liner panel is fixed relative to the outer shell at one location proximate to a leading portion. In addition, each linear panel is restrained against radial movement relative to the outer shell, but relative axial and circumferential movement between the liner panel and outer shell is permitted. Mating spacers and hooks are selectively engageable to mount a trailing portion of each liner panel to the outer shell. Lateral edges of adjacent liner panels are mutually configured to prevent escape of heat while accommodating circumferential expansion.

In a customary fashion, the combustion chamber has a cylindrically configured outer shell having a longitudinal axis and a plurality of annular lands lying in planes transverse to the axis at its based locations along the axis. Circumferential rows of the liner panels are mounted to the annular lands thereby providing a shingling effect. Each liner panel is riveted to its associated annular land at a pair of locations proximate to its leading portion. Although one of the rivets absolutely fixes the liner panel to the outer shell, the other rivet, located a distance away from the first rivet, extends through a mounting hole in the outer shell which is sufficiently large to enable relative axial and circumferential movement between the liner panel and the outer shell while preventing any relative radial movement between the liner panel and the outer shell. Although one pair of mating spacers and hooks for mounting the trailing portion of each liner panel to the outer shell may be adequate, it is preferred that a pair of such spacers and hooks be utilized at spaced locations adjacent the trailing portion of the liner panel for best effect.

In one embodiment of the invention, the lateral portions of adjacent liner panels have mutually doubled edges which are slightly spaced apart under ambient conditions, but which are caused to move into mutually sliding, camming engagement by reason of expansion of the liner panels during operation of the combustion chamber.

In another embodiment, the lateral portions of adjacent liner panels have overlapping members, respectively, which are slidably engaged to accommodate expansion of the liner panels during operation of the combustion chamber.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings, which are incorporated in and constitute a part of this invention, illustrate some of the embodiments of the invention and, together with the description, serve to explain the principles of the invention in general terms.

BRIEF DESCRIPTION OF THE DRAWINGS

FIG. 2 is a detail perspective view, partly cut away and shown in section, of components generally illustrated in FIG. 1, as seen from a different perspective;

FIG. 4 is an enlarged detail cross section view similar to FIG. 3, illustrating another portion of FIG. 1;

FIG. 5 is a detail cross section view, taken generally along line 5—5 in FIG. 2;

FIG. 5A is a side elevation view of a modified component illustrated in FIG. 5;

FIG. 6 is a detail perspective view illustrating in greater detail the relationship between certain components illustrated in FIG. 2; and FIG. 7 is a detail perspective view, similar to FIG. 2, illustrating another embodiment of the invention.

DETAILED DESCRIPTION OF THE PREFERRED EMBODIMENTS

Figure 1:
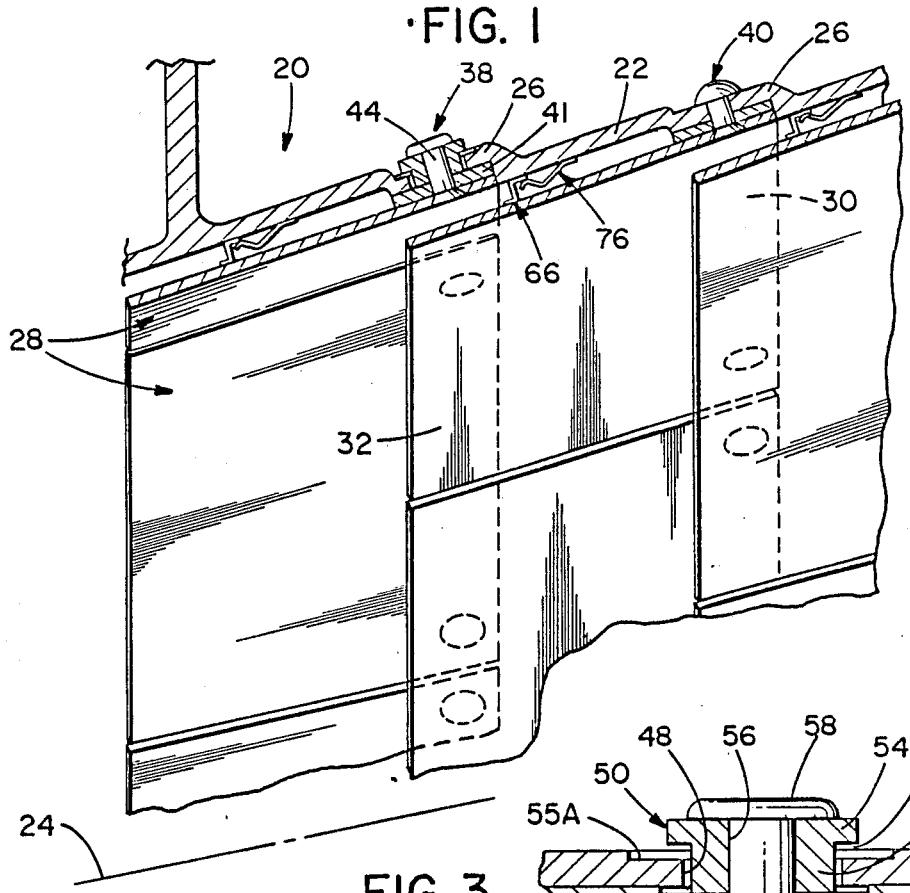
FIG. 1 is a detail perspective view illustrating a portion of the interior of a combustion chamber for a gas turbine engine embodying the present invention.

Turn now to the drawings and initially to FIG. 1 which illustrates a portion of a combustion chamber 20 for a gas turbine engine embodying the present invention. In a customary manner, the combustion chamber includes a generally cylindrically configured outer shell 22 which has a longitudinal axis 24 and a plurality of annular lands 26 lying in planes transverse to the axis 24 and at spaced locations along that axis.

Figure 1A:
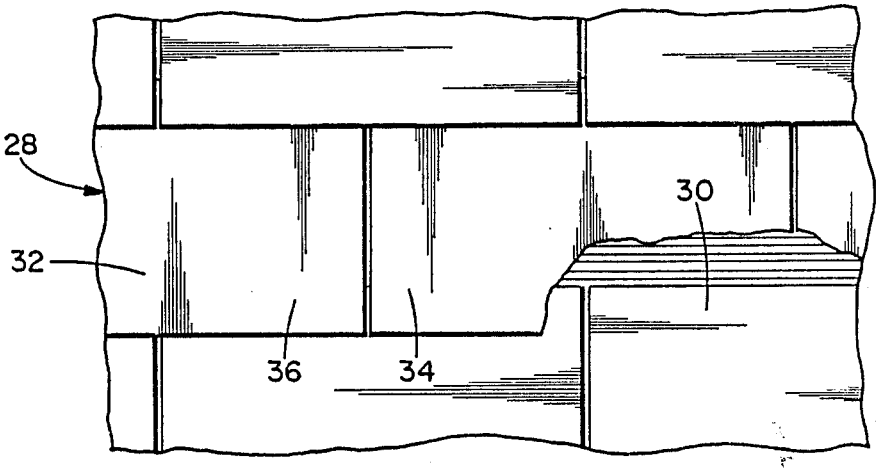
FIG. 1A is a detail plan view illustrating the interior surface of a combustion chamber as viewed from the central regions thereof.

With continuing reference to FIG. 1, the combustion chamber 20 is provided with a plurality of axially spaced concentrically disposed segmented liner panels 28 mounted generally in cantilever fashion on the annular lands 26 and arranged in side-by-side circumferential relationship. Each of the liner panels has a leading portion 30, a trailing portion 32, and opposed lateral portions 34, 36 which extend, respectively, between the leading portion 30 and the trailing portion 32. As seen especially well in FIGS. 1 and 1A, trailing portions 32 of a row of more forwardly located liner panels overlap leading portions 30 of the next succeeding row of liner panels and adjacent rows of liner panels are circumferentially staggered for optimum efficiency.

In a known manner, forming no part of the present invention, cooling air is introduced at the forward end of the combustion chamber into the annular cavity existing between the outer shell 22 and the liner panels 28. The mounting system about to be described serves to maintain the relative positioning between the liner panels and the outer shell so a not to interfere with the flow of the cooling air. The mounting system also serves to insure the structural integrity of the combustion chamber notwithstanding wide temperature fluctuations. As seen particularly well in FIG. 2, each of the liner panels 28 is attached to its associated land 26 by means of a pair of circumferentially spaced rivets 38, 40. A circumferentially extending shim 41 may be provided intermediate the liner panel 28 and the land 26 to assure proper spacing.

Figure 3:
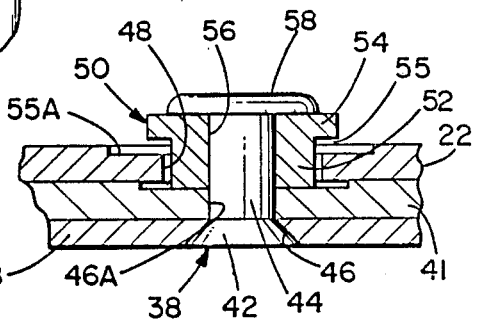
FIG. 3 is an enlarged detail cross section view illustrating a portion of FIG. 1.

As seen in FIG. 3, the rivet 38 has a flat head 42 enabling its flush mounting on the inner surface of the liner panel 28. A shank 44 integral with the head 42 extends through a hole 46 in the leading portion 30 of the liner panel 28, and through an associated hole 46A in the shim 41, then freely through an outsized bore 48 in the outer shell 22. That is, the diameter of the bore 48 is substantially greater than that of the shank 44. However, as also seen in FIG. 3, a bushing 50 is provided which has a plug element 52 received in the bore 48 and an annular flange 54 overlying the bore. The plug element 52 has a diameter which provides some clearance with the bore 48. The bushing 50 itself has a through bore 56 which is of substantially the same diameter as that of the shank 44 and serves to fittingly receive the shank. A round head 58 of the rivet 38 is integral with the shank 44 opposite the flat head 42 and overlies the flange 54 to firmly fix the bushing 50 to the liner panel 28. A gap 55 is provided between the annular flange 54 and a flattened chordal surface 55A of the outer shell 22. This construction permits radial thermal expansion.

The mounting construction of the rivet 40 (see FIG. 4) is somewhat different from that of the rivet 38 although it also has a flat head 60 so as to be flush mounted with the inner surface of the liner panel 28. The rivet 40 also has an integral shank 62 but it fittingly extends through other holes 46B, 46C, and 48A spaced from the first described holes 46, 46A, and 48. In this instance, no bushing 50 is provided, but the shank 62 terminates at a round head 64 which overlies the hole 48A and engages the outer shell 22 around its rim. Thus, the rivets 40 prevent movement of the liner panel 28 relative to the outer shell 22 in all direction, that is, axially, circumferentially, and radially, while the rivets 38 permit relative movement among those components in each of those directions.

The system of mounting the liner panels 28 on the outer shell 22 also provides for supporting the trailing portion 32 of the liner panel. Viewing FIGS. 2 and 5, this is achieved by means of a mutually cooperating spacer hook and clip construction. Specifically, a spacer hook 66 is illustrated as being generally z-shaped having a first foot member 68 fixed to the liner panel 28, a second foot member 70 parallel to, but spaced from the foot member 68; and a transverse bight member 72 integral with and extending between the foot members 68, 70. The spacer hook 66 is preferably composed of metal and may be stamped or cast with the liner panel 28, or fabricated in some other suitable fashion. Depending upon the relative materials involved, the foot member 68 may be welded, brazed, or otherwise suitably bonded to an outer surface of the liner panel 28 in a suitable manner recognizing the intense temperatures to which the construction is subjected.

Cooperating with the spacer hook 66 is an elongated spring clip member 76 fixed at an end 78 to the outer shell. An upturned free end 80 opposite the fixed end 78 defines an entrance into a reception region 82 intermediate the fixed end and the free end. The free end 80 is biased toward engagement with the inner surface of the outer shell 22. When it is desired to mount a liner panel 28 to the outer shell 22, it is moved from a distant location in a forward direction and generally parallel to the axis of the combustion chamber toward the particular annular land to which it is to be attached. With continued movement, the foot member 70 is caused to engage the free end 80 of the spring clip member 76, moving the free end 80 radially aside and thereby entering the reception region 82. Forward movement of the liner panel can continue until the free end 80 is engaged by the bight member 72 at which time the holes 46 are generally aligned with the holes 48 thereby enabling the rivets 38, 40 to be applied in accordance with the construction previously described. The foot member 70 is urged by the free end 80 in the direction of the outer shell 22 and the spacer hook thereby holds the trailing portion of the liner panel at a fixed distance away from the outer shell equivalent to the length of the bight member 72.

It will be appreciated that although the spacer hook 66 is generally t-shaped, that is a mere choice of construction and is for all intents and purposes equivalent to a c-shaped spacer hook 66A as seen in FIG. 5A. The modified spacer, hook 66A has a pair of feet members 68A, 70A extending in the same direction transversely away from an intermediate bight member 72A. In all other respects, the modified spacer hook 66A performs in the same manner as the spacer hook 66.

In the construction illustrated in FIG. 6, it is seen that the lateral portions 34, 36 have beveled edges 84, 86, respectively. As seen especially in FIGS. 1 and 1A, the circumferential spacing between adjacent liner panels 28 is very small under ambient conditions to minimize passage of cooling air from the annular region between the liner panels 28 and the outer shell 22 into the central regions of the combustion chamber during operation. However, during the operation of the combustion chamber, the liner panels 28 are caused to expand circumferentially and axially. Although each liner panel 28 is held fixed by means of the rivet 40, the loose reception of the rivet 38 within its associated hole 48 as well as the sliding engagement between foot member 70 of the spacer hook 66 and the free end 80 of the foot member 76, the liner panel 28 is permitted to expand under operating conditions both circumferentially and axially, as well as radially. With such circumferential expansion, the beveled edges 84, 86 are caused to move into mutually sliding, camming engagement until, in an extreme instance, an outer surface of one liner panel 28 may become engaged by an inner surface of the next succeeding liner panel in a circumferential direction. Of course, upon cooling of the structure to ambient temperatures, the original spacing between adjacent liner panels 28 will again occur. Axial expansion of adjacent liner panels 28 would be at a similar rate in view of the fact that they would be of similar materials, although even if adjacent liner panels were, respectively, of different materials, axial sliding could occur at the beveled edges 84, 86.

Thus, it is seen that the spacer hook 66 and the spring clip member 76 lie in a common plane which is generally perpendicular to a longitudinal axis of the combustion chamber such that the second foot member 70 is movable within the plane between a disengaged position distant from the spring clip member 76 and an engaged position received within the reception region 82 and engageably held by the free end 80 biased toward the outer shell 22. Although one mating hook and clip member combination may be adequate for a given liner panel 28, it is preferred, as illustrated, that one pair be generally associated with each lateral portion 34, 36 in order to obtain optimum support for the liner panel relative to the outer shell and for added safety in the event one should fail.

An alternative construction is illustrated in FIG. 7 wherein a modified spacer hook 88 is illustrated as being engageable with a modified clip member 90. In this embodiment, the spacer hook 88 is illustrated as being z-shaped, although it may c-shaped in the manner of spacer hook 66A of FIG. 5A. As illustrated in FIG. 7, the spacer hook 88 has a first foot member 92 being welded, brazed, or otherwise fixedly mounted to the liner panel 28. A second foot member 94 is parallel to and spaced from the foot member 92 by means of a bight member 96 and the foot member 94 is engageable with the outer shell 22 and serves to hold the trailing portion 32 at a uniform spaced distance away from the outer shell 22 in the manner previously explained with respect to the spacer hook 66 and hook 74. A variation of the spacer hook 88 from the spacer hook 66 is that the former lies in a plane which is generally perpendicular to a longitudinal axis of the combustion chamber rather than parallel to that axis. In a similar fashion, the clip member 90 is identical to the clip member 76 except that it also lies in a plane common to that of the modified spacer hook 88, when the liner panel is in its mounted position, which plane is generally perpendicular to the longitudinal axis of the combustion chamber. In this instance, the liner panel 28 is mounted to the outer shell 22 by moving it to a position such that the spacer hook 88 lies in a plane common to that of the clip member whereupon the liner panel 28 is then moved circumferentially within that plane until the foot member 94 is received within the reception region 82 and engageably held by the free end 80, being biased toward the outer shell 22. When the free end 80 engages the bight 96, the holes 46 and 48 are substantially aligned to enable application of the rivets 38, 40 in the manner previously described.

In the instance of the modified construction illustrated in FIG. 7, adjacent liner panels 28A are seen to have modified lateral portions 34A and 36A. The lateral portions 34A, 36A of adjacent liner panels 28A are seen to be overlapping and slidably engaged so as to accommodate expansion of the liner panels during operation of the combustion chamber. The extent of the overlap must be determined so as to assure adequate room for circumferential movement of the adjacent liner panels 28A even under the most extreme temperature conditions. Additionally, it will be appreciated that the amount of overlap of the lateral portions 34A, 36A must be sufficient to enable the clip member 90 to be totally disengaged from the hook 88 to enable installation or removal of the liner panel. This construction is preferred over the construction illustrated in FIG. 6 because there are no discontinuities in a circumferential direction between adjacent liner panels. This results in improved retention of the air between the liner panels and the outer shell and thereby increases the efficiency of the combustor.

While the preferred embodiments of the invention have been disclosed in detail, it should be understood by those skilled in the art that various modifications may be made to the illustrated embodiments without departing from the scope thereof as described in the specification and defined in the appended claims.

What is claimed is:

1. A system of mounting segmented liner panels on the interior of an outer shell of a combustion chamber for a gas turbine engine where the outer shell is generally cylindrically configured comprising:

a plurality of axially spaced concentrically disposed segmented liner panels arranged in side by side circumferential relationship, each of said liner panels having a leading portion, a trailing portion, and opposed lateral portions extending, respectively, between said leading portion and said trailing portion;

first mounting means for fixedly attaching each of said liner panels to an annular land of the outer shell at a first location proximate to said leading portion such that said first location of said liner panel is thereby denied axial, radial, and circumferential movement relative to the outer shell;

second mounting means for attaching each of said liner panels to the annular land of the outer shell at a second location distant from said first location but proximate to said leading portion such that radial, axial, and circumferential movement of said liner panel relative to the outer shell are permitted; and third mounting means for attaching each of said liner panels to the outer shell at a third location proximate to said trailing portion such that said third location of said liner panel is thereby held at a spaced distance away from the outer shell and generally restrained against radial movement relative to the outer shell while axial and circumferential movement of said liner panel relative to the outer shell are permitted.

2. A mounting system as set forth in claim 1 wherein said third mounting means includes:

spacer hook means fixed to each of said liner panels and having a foot member engageable with the outer shell at the spaced distance from said liner panel; and retainer means having one end fixed to the outer shell and an opposite end biased toward engagement with the outer shell but releasably engageable with said foot member to selectively hold said foot member in firm engagement with the outer shell.

3. A mounting system as set forth in claim 2 wherein said spacer hook means has a first foot member fixed to said liner panel, a second foot member parallel to said first foot member at the spaced distance therefrom, and a transverse bight member integral with and extending between said first and second foot members; and retainer means having one end fixed to the outer shell and a free end opposite said fixed end biased into engagement with the outer shell but releasably engageable with said second foot member to selectively hold said second foot member in firm engagement with the outer shell.

4. A mounting system as set forth in claim 3 wherein said retainer means is an elongated spring clip member defining a reception region intermediate said fixed end and said free end, said clip member being upturned at its free end to define an entrance into the reception region;

whereby engagement of said upturned end by said second foot member upon selective movement of said spacer hook means toward said spring clip member cams said upturned end away from the outer shell permitting entry of said second foot member into the reception region.

5. A mounting system as set forth in claim 4 wherein said spacer hook means and said retainer means lie in a common plane which is generally perpendicular to a longitudinal axis of the combustion chamber, said second foot member being movable within said plane between a disengaged position distant from said spring clip member and an engaged position received within the reception region and engageably held by said free end of said spring clip member against the outer shell.

6. A mounting system as set forth in claim 4 wherein said spacer hook means and said retainer means lie in a common plane which is generally parallel to a longitudinal axis of the combustion chamber, said second foot member being movable within said plane between a disengaged position distant from said spring clip member and an engaged position received within the reception region and engageably held by said free end of said spring clip member against the outer shell.

7. A mounting system as set forth in claim 1 wherein said first mounting means includes a first rivet having a shank extending through holes in said liner panel and in the outer shell, respectively, having substantially the same diameter as said shank, said first rivet having opposed heads integral with said shank engaged, respectively, within said liner panel and with the outer shell; and wherein said second mounting means includes a second rivet having a shank extending through holes in said liner panel and in the outer shell, respectively, at least one of the holes in said liner panel and in the outer shell being of substantially larger diameter than that of said shank, said second rivet having opposed heads integral with said shank engaged, respectively, with said liner panel and with said outer shell.

8. A mounting system as set for the in claim 7 wherein the holes of said first and second mounting means in said liner panel are of the same diameter, being of substantially the same diameter as that of said shank;

wherein the holes of said first and second mounting means in the outer shell are of the same diameter, being of substantially larger diameter than that of said shank; and wherein said first mounting means includes a bushing having a plug element received in the hole in the outer shell and an annular flange overlying the hole, and having a bore therethrough being of substantially the same as that of said shank for receiving the shank therethrough.

9. A mounting system as set forth in claim 1 wherein said lateral portions of first and second adjacent liner panels have first and second mutually beveled edges, respectively, said first and second beveled edges being spaced apart under ambient conditions but being caused to move into mutually sliding, camming engagement by reason of expansion of said liner panels during operation of the combustion chamber.

10. A mounting system as set forth in claim 1 wherein said lateral portions of first and second adjacent liner panels have first and second overlapping members, respectively, said first and second overlapping members being slidably engaged to accommodate expansion of said liner panels during operation of the combustion chamber.

11. In a combustion chamber for a gas turbine engine, the improvement comprising:

a generally cylindrically configured outer shell having a longitudinal axis and a plurality of annular lands lying in planes transverse to said axis and at spaced locations along said axis;

a plurality of axially spaced concentrically disposed segmented liner panels arranged in side by side circumferential relationship, each of said liner panels having a leading portion, a trailing portion, and opposed lateral portions extending, respectively, between said leading portion and said trailing portion, first mounting means for fixedly attaching each of said liner panels to an associated one of said annular lands at a first location proximate to said leading portion such that said first location of said liner panel is thereby denied axial, radial, and circumferential movement relative to said outer shell;

second mounting means for attaching each of said liner panels to said associated annular land at a second location distant from said first location but proximate to said leading portion such that radial, axial and circumferential movement of said liner panel relative to said outer shell is permitted; and third mounting means for attaching each of said liner panels to said outer shell at a third location proximate to said trailing portion such that said third location of said liner panel is thereby held at a spaced distance away from said outer shell and restrained against radial movement relative to said outer shell while axial and circumferential movement of said liner panel relative to said outer shell are permitted.

12. A system of mounting a segmented liner panel on the interior of an outer shell of a combustion chamber for a gas turbine engine comprising:

spacer hook means fixed to the liner panel and having a foot member engageable with the outer shell at a spaced distance away from the liner panel; and retainer means having one end fixed to the outer shell and an opposite end biased toward engagement with the outer shell but releasably engageable with said foot member to selectively hold said foot member in firm engagement with the outer shell.

13. A system of mounting a segmented liner panel on the interior of an outer shell of a combustion chamber for a gas turbine engine comprising:

spacer hook means having a first foot member fixed to the liner panel, a second foot member parallel to said first foot member at a spaced distance therefrom, and a transverse bight member integral with and extending between said first and second foot members; and retainer means having one end fixed to the outer shell and a free end opposite said fixed end biased toward engagement with the outer shell but releasably engageable with said second foot member to selectively hold said second foot member in firm engagement with the outer shell.

14. A mounting system as set forth in claim 13 wherein said retainer means is an elongated spring clip member defining a reception region intermediate said fixed end and said free end, said clip member being upturned at its free end to define an entrance into the reception region;

whereby engagement of said upturned end by said second foot member upon selective movement of said spacer hook means toward said spring clip member cams said upturned end away from the outer shell permitting entry of said second foot member into the reception region.

15. A mounting system as set forth in claim 14 wherein said spacer hook means and said retaining means lie in a common plane which is generally perpendicular to a longitudinal axis of the combustion chamber, said second foot member being movable within said plane between a disengaged position distant from said spring clip member and an engaged position received within the reception region and engageably held by said free end of said spring clip member against the outer shell.

16. A mounting system as set forth in claim 14 wherein said spacer hook means and said retainer means lie in a common plane which is generally parallel to a longitudinal axis of the combustion chamber, said second foot member being movable within said plane between a disengaged position distant from said spring clip member and an engaged position received within the reception region and engageably held by said free end of said spring clip member against the outer shell.

* * * * *